United States Patent [19]

McRae et al.

[11] Patent Number: 4,717,540

[45] Date of Patent: Jan. 5, 1988

[54] METHOD AND APPARATUS FOR DISSOLVING NICKEL IN MOLTEN ZINC

[75] Inventors: Dale L. McRae, Fruitvale; Robert D. H. Willans, Trail; Eric L. Mawer, Fruitvale, all of Canada

[73] Assignee: Cominco Ltd., Vancouver, Canada

[21] Appl. No.: 904,536

[22] Filed: Sep. 8, 1986

[51] Int. Cl.[4] ..... C22C 18/00

[52] U.S. Cl. ..... 420/513; 75/61; 75/93 R; 420/129

[58] Field of Search ..... 75/61, 93 R; 420/590, 420/129

[56] References Cited

U.S. PATENT DOCUMENTS

| | | | |
|---|---|---|---|
| 3,567,204 | 3/1971 | Ando | 75/61 |
| 3,972,709 | 8/1976 | Chia | 75/61 |
| 4,191,563 | 3/1980 | Smartt | 75/53 |

*Primary Examiner*—Peter D. Rosenberg

*Attorney, Agent, or Firm*—Arne I. Fors; Robert F. Delbridge

[57] ABSTRACT

A rotatable device is suspended in a melt of zinc and the device is rotated to draw a vortex in the melt. The device comprises a hollow cylinder having an open top and a closed bottom. An array of openings in the cylinder side wall is adapted to allow zinc melt to pass through. Nickel is added in particulate form into the vortex in the device. The openings in the cylindrical wall are adapted to retain the nickel particulates in the device to be washed with molten zinc until the particulates are substantially dissolved. The temperature is kept at a minimal value, i.e., no superheat is required to dissolve the nickel homogeneously throughout the zinc melt. After the nickel is dissolved, the nickel-zinc melt is solidified in zinc slabs. The zinc slabs containing nickel have narrow standard deviations from their specification. The dissolving proceeds more efficiently with formation of less dross and less off-specification material, proceeds faster and in less time than heretofore possible, and allows production on a continuous basis.

13 Claims, 7 Drawing Figures

22
20
14
35
38
36
28
24
18
26
10
12
30
16

3
22

50
34
50
24
3

METHOD AND APPARATUS FOR DISSOLVING NICKEL IN MOLTEN ZINC

BACKGROUND OF THE INVENTION

This invention relates to a method and apparatus for dissolving nickel in molten zinc.

When nickel is added to molten zinc, the dissolution of nickel does not proceed readily. When nickel, which has a relatively high melting point, is added in particulate form to molten zinc, the rate of dissolution is low and a high temperature increment over the melting temperature of the zinc must be provided to increase the rate. In addition, it has been observed that the nickel particulates form semi-plastic masses or agglomerates with the zinc and these masses or agglomerates are slow to dissolve and accumulate in the bottom of the alloying vessel. Efforts to accelerate the dissolution by known methods such as vortex, high-velocity, or high-shear mixing are only partly successful, such mixing often also causing formation of considerable amounts of dross. Dross must not only be removed and treated, but also may contaminate the zinc slabs. Dross formation is aggravated by exposure to oxidizing conditions. As a result of these problems, the zinc slabs containing nickel not only have a relatively large standard deviation from the desired composition specification but sometimes do not meet the specification and must be reprocessed. These problems tend to restrict the process to more costly batch processes.

SUMMARY OF THE INVENTION

We have now found that the above-stated problems in the dissolution of nickel in molten zinc and of the zinc slabs processing may be alleviated by using a specially designed rotating device whereby dross formation is sharply reduced and wherein the nickel is virtually completely and uniformly dissolved in the molten zinc in the rotating device.

The rotating device is submerged in a melt of zinc contained in a vessel. The device is rotated and nickel is added to the vessel, while allowing the zinc melt to circulate through the device. The nickel is added in particulate form to the rotating device and the nickel is essentially retained within the device until virtually dissolved. If desired, other metal or metals such as, for example, lead may be added in addition to the Ni to enhance properties. Lead can be added into or outside the rotating device. The use of the rotating device results in the formation of less dross and in more efficient and uniform mixing of the components, and yields zinc slabs containing nickel or zinc slabs containing nickel and lead that have a lower standard deviation from specification, thereby allowing the continuous production. The dissolution of nickel can also be carried out more efficiently at a lower temperature increment and in less time.

Accordingly, it is an object of the present invention to provide a method for dissolving nickel in molten zinc with reduced dross formation. It is another object to provide a method for dissolving nickel at an improved rate of dissolution. It is still another object to provide a method for dissolving nickel in zinc resulting in nickel-containing zinc slabs with a reduced standard deviation from composition specification. It is a further object to provide a rotating device for the dissolution of nickel in molten zinc. These and other objects of the present invention will become clear from the detailed description.

Accordingly, there is provided a method for the dissolution of nickel in molten zinc which comprises the steps of establishing a melt of zinc in a vessel; submerging a rotatable device in said melt; said rotatable device consisting of a hollow cylinder having a side wall with an upper end and a lower end, said cylinder being open at the upper end and closed at the lower end, said side wall having an array of equispaced openings adapted to retain nickel added in particulate form in said device in said rotatable device and to allow said molten zinc to pass through said openings, and means attached to the bottom plate for rotation of the rotatable device; rotating said rotatable device at a predetermined speed sufficient to draw at least a partial vortex in said melt of zinc and said rotatable device; feeding nickel in particulate form into said vortex in an amount sufficient to provide a melt of desired composition of zinc containing dissolved nickel; washing said nickel added in said device with said melt of zinc while rotating said device causing said molten zinc to flow into the top of said device and out through said openings; said washing with molten zinc while rotating said device causing dissolution of said nickel in said rotatable device and formation of a melt of zinc containing said predetermined amount of nickel; and withdrawing a melt of said desired composition from said vessel.

Preferably, said cylinder of the rotatable device has a diameter relative to the diameter of said vessel in the range of about 1.5:1 to about 3.5:1; said rotatable device is rotated at a predetermined speed in the range of about 100 to about 600 revolutions per minute; and a predetermined amount of lead may be added to said vessel in addition to said predetermined amount of nickel.

According to an embodiment of the apparatus of invention, there is provided a rotatable device for the dissolution of nickel in a melt of zinc in a vessel, said rotatable device comprising a hollow cylinder having a side wall with an upper end and a lower end, said cylinder being open at the upper end and closed at the lower end, said side wall having an array of openings formed therein adapted to allow said melt to pass through said openings, said cylinder having a diameter relative to the diameter of said vessel in the range of about 1.5:1 to about 3.5:1; and means attached to said rotatable device for rotating said cylinder at a speed in the range of about 100 to about 600 revolutions per minute whereby at least a partial vortex can be formed in the said melt.

The total surface area of said openings in the rotatable device is in the range of about 2 to 40% of the outside surface area of the side wall of the cylinder. The openings in the side wall are of a circular cross-section having a diameter greater than about 3 mm and, preferably in the range of about 3 to 16 mm. Alternatively, the openings in the side wall are of a rectangular cross-section having a width greater than about 3 mm and, preferably, having a surface area in the range of about 75 to 600 $mm^2$. The direction of the openings in the side wall may be at an angle in the range of from about 1° to about 40° off-set from the radius of the side wall. The openings in the side wall may diverge outwardly through the side wall at an angle in the range of about 1° to about 15°.

BRIEF DESCRIPTION OF THE DRAWINGS

The invention will now be described with reference to the accompanying drawings in which.

DETAILED DESCRIPTION

The method and apparatus of the present invention are particularly suitable for dissolving nickel in a melt of zinc in a vessel prior to casting the melt in slabs.

Figure 1:
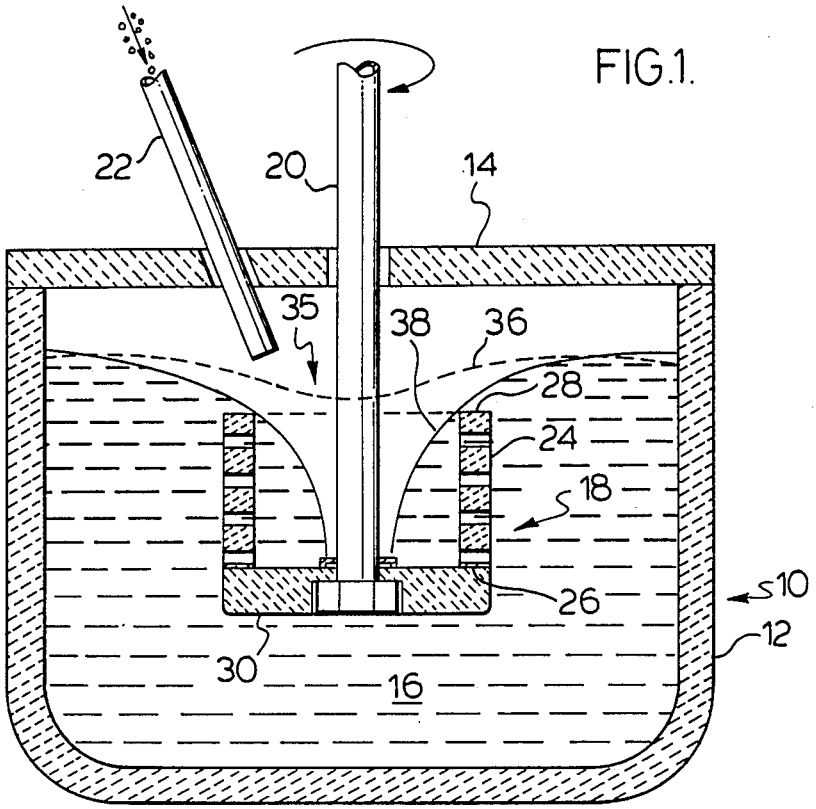
FIG. 1 is a sectional view of a vessel with the rotatable device of the present invention.

With reference to FIG. 1, the apparatus comprises a suitable vessel for containment of molten metal, generally indicated at 10. Vessel 10 comprises a main body 12, wherein the dissolution of nickel in a melt of zinc is conducted. If desired, vessel 10 maybe provided with a cover indicated at 14. The vessel may have anyone of a number of conventional configurations and is made from known high temperature resistant materials. The vessel may also comprise two or more compartments in series (not shown). For example, the nickel-zinc melt may be produced in a three-compartment apparatus, wherein the melt is prepared in a first compartment containing the rotating device (to be described) of the present invention, the melt is allowed to flow from the first compartment into a second compartment wherein any dross would be separated, and the melt is then allowed to flow into a third compartment from which the melt is flowed or pumped into moulds and solidified in slabs. Means (not shown) are usually provided to heat vessel 10. Vessel 10 is provided with suitable means (not shown), such as an overflow, a taphole or a pump, for the removal of melt from vessel 10. A melt 16 of zinc is provided in vessel 10. A rotatable device generally indicated at 18 is suspended in melt 16. Rotatable device 18 has a suitable diameter (to be described) and is centrally mounted on a shaft 20 which is affixed to rotatable device 18. Shaft 20 passes through cover 14 and is connected to drive means (not shown) for rotating shaft 20 and affixed device 18.

The nickel, which has a relatively high melting point compared to zinc is fed in particulate form into device 18 by means of feeding means 22, which passes through cover 14 of vessel 10.

Rotatable device 18 comprises a cylindrical side wall 24 having a lower end 26 and an upper end 28. Attached to lower end 26 of wall 24 is a bottom plate 30. Device 18 thus has a substantially cylindrical configuration with an open top and a closed bottom. The solid bottom plate 30 closes the lower end 36 of the cylindrical side wall and forms a convenient base to which to attach centrally the shaft 20. Shaft 20 may be hollow and may be adapted for feeding a gas, preferably inert, to the base of the device through openings 32 that are provided at its lower extremity, as shown in FIG. 3. Cylindrical side wall 24 is provided with an array of openings 34 to be described specifically with reference to FIGS. 2-7. The openings may have anyone of a number of suitable configurations and may have a wide range of total surface areas. The openings conveniently comprise a total surface area in the range of about 2 to 40% of the surface area of the cylindrical wall 24. Device 18 is preferably made of a material resistant to the effects of the melt material such as, for example, silicon carbide, fused silica or other ceramic material, or graphite, and the like.

According to the method of the present invention, melt 16 of molten zinc is added to vessel 10. Rotatable device 18 is suspended and submerged in melt 16 at a convenient depth and rotated by rotating shaft 20 with the external rotating means. The speed of rotation is such that a vortex 35, shown most clearly in FIG. 1, is drawn into the surface of the melt 16. The vortex is at least a partial vortex, i.e. an indentation in the surface of the melt as shown with interrupted line 36 or a vortex drawn onto bottom plate 30 as shown with solid line 38. Satisfactory vortices are drawn, for example, when the rotatable device has a diameter in the range of about 175 to 380 mm and is rotated at speeds in the range of about 100 to 600 revolutions per minute, while the ratio between the diameter of vessel 10 and the diameter of rotatable device 18 is in the range of about 1.5:1 to 3.5:1. The formation of a satisfactory and efficient vortex is accomplished over a range of rotational speeds that is greater than can be obtained with a conventional blade-type mixing device. Rotatable devices having a diameter in the above stated range are suitable for the dissolution of nickel in molten zinc without formation of excessive amounts of dross. For making nickel-containing melts of zinc it is desirable to draw a vortex as shown with line 38. A vortex drawn onto the bottom plate 30 of device 18 is also desirable when an inert gas is supplied to prevent any oxidation. The gas emanating from holes 32 in the lower extremity of shaft 20 forms a blanket above the melt 16 in vessel 10.

The rotation of device 18 causes a flow of melt 16 to enter the open top of device 18, the flow to pass in a rotating fashion, caused by the vortex, downward through the device and then to pass through the array of openings 34 back into melt 16. Solid particulates of nickel are added into vortex 35 from feeding means 22 at a controlled rate and in a predetermined amount that is sufficient to yield a zinc melt containing the desired amount of nickel. Feeding means 22 may include means (not shown) for controlling rate and amount.

The nickel usually forms semi-plastic masses or agglomerates with the melt 16 of zinc in vessel 10. Without being bound by theoretical explanations, it is thought that the melt and the particulates of nickel form intermediate, high melting point alloys in the form of semi-plastic masses or agglomerates that accumulate in the device and are very slow to dissolve. The rotating device provides a wall that holds the agglomerates in the device by virtue of the centrifugal force created by the rotation. The openings in the cylindrical wall of the device would provide a means for the agglomerates to pass through, but the agglomerates are generally larger than the openings in the initial stages of the dissolution. The more fluid melt forms channels through the agglomerates at each opening and the openings appear to act like a sieve, allowing the melt to pass through and retaining the agglomerates in the device while washing and eroding them until substantially dissolved. Completion of the dissolution of small particles takes place readily in melt 16 and a homogeneous melt of the desired composition is formed.

The semi-plastic masses or agglomerates normally require a high temperature increment over the melting temperature of the zinc. Using the rotatable device 18 of the present invention, the nickel added to device 18 is retained in the device and is continuously washed by the flow of melt into and out of the device. The continuous washing of the nickel with melt causes dissolution of the nickel at an increased rate. The dissolution may therefore be conducted more efficiently at lower temperatures, i.e. at a smaller temperature increment, and in less time. Besides the obvious savings in energy, the operating at lower temperatures is particularly advantageous. In the conventional operation of dissolving nickel in zinc, a high temperature increment is required. This means that the zinc melt must be supplied to the alloying vessel at a high temperature. This in turn requires operating the zinc melting furnace at a high temperature which causes a rapid deterioration of the furnace lining by the highly fluid molten zinc. By retaining the nickel in the rotatable device, the mechanical washing of the nickel by the zinc puts the nickel into solution at lower zinc temperatures which do not adversely affect the furnace lining. Thus, substantially no superheat need to be provided to dissolve the nickel homogeneously throughout the melt of zinc. In addition, by retaining the nickel in a limited volume, formation of dross is reduced. Another result of using the rotatable device is that the melt, when made by the method according to the invention, after having been removed from vessel 10, is more homogeneous and contains less contaminants. This translates into an important advantage in that zinc slabs produced from the nickel-containing zinc melt, when produced over a period of time, have a reduced standard deviation from composition specification. Thus, higher quality zinc slabs can be produced consistently.

The production of zinc slabs with reduced standard deviation makes it possible to perform the dissolution continuously. In continuous dissolution operation, melt 16 at the desired temperature is continuously added to vessel 10 in a measured amount and nickel particulates are added continuously from feeding means 22 at a predetermined rate and in a predetermined amount into vortex 35 in melt 16 and rotating device 18. In addition to the nickel, a second metal such as lead may be continuously added directly to the melt, i.e. outside the rotatable device. Lead is also added in a predetermined amount sufficient to produce a melt of zinc containing predetermined amounts of nickel and lead. When zinc slabs containing nickel are produced, the slabs contain preferably 1.8% nickel or less, and when containing nickel and lead, the combined nickel and lead content is preferably 1.8% by weight or less. If desired, zinc slabs with higher contents may be produced. The level of melt 16 in vessel 10 is maintained substantially constant using a suitable level control system. The level is preferably maintained with a variation not exceeding about 5 mm. A volume of melt of desired composition is removed continuously from vessel 10. The removed melt is poured into moulds and solidified into zinc slabs. The melt may be removed from vessel 10 through a suitably located taphole (not shown) or by means of an overflow or a suitable pump for liquid metal. Alternatively, as described above, vessel 10 may comprise two or more compartments (not shown). For example, the nickel-zinc or nickel-lead-zinc melts may be produced in a three-compartment apparatus, wherein the melt is prepared in a first compartment, allowed to flow from the first compartment into a second compartment wherein any dross would be separated, and then allowed to flow into the third compartment from which the melt is pumped into moulds and solidified in slabs.

Figure 2:
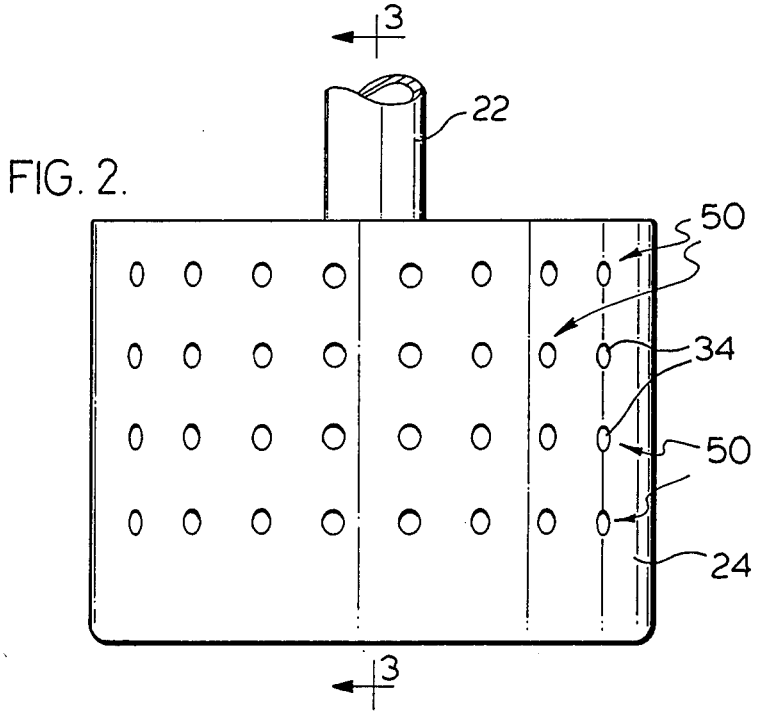
FIG. 2 is a side view of one embodiment of the rotatable device showing an array of circular openings.
Figure 3:
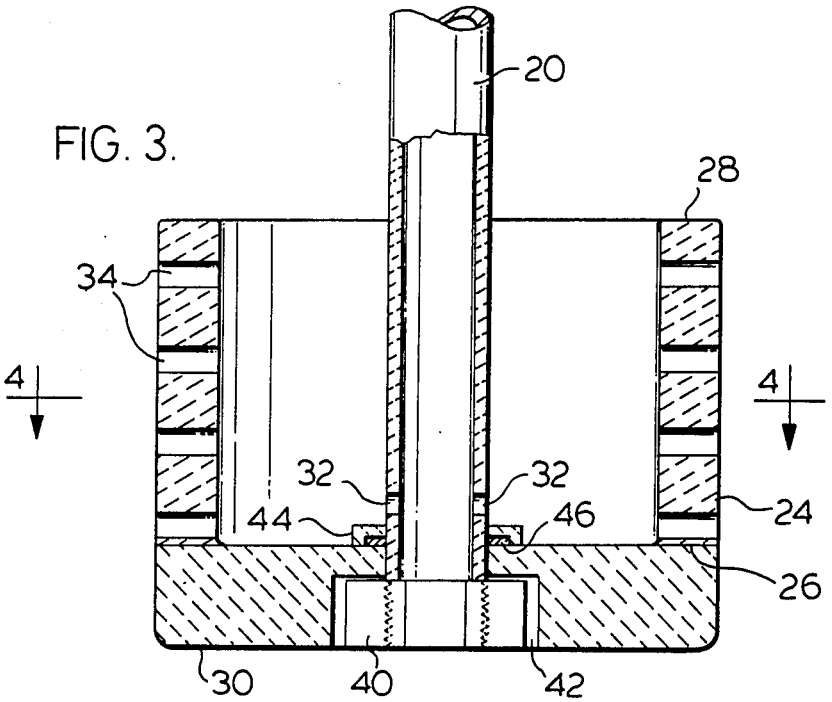
FIG. 3 is a sectional view, partly in perspective, along line 3—3 of FIG. 2 of the rotatable device.

With reference to one preferred embodiment of device 18 as shown in FIGS. 2 and 3, the rotatable device 18 comprises a cylindrical side wall 24 having an upper end 28 and a lower end 26. Attached to lower end 26, or integral with cylindrical side wall 24, is a bottom plate 30. Shaft 20 is centrally affixed to device 18 with a nut 40 into inset hole 42 provided in bottom plate 30. Shaft 20 has a peripheral flange 44 which has an inlaid seal 46 by which flange 44 seals onto the top of bottom plate 30. Shaft 20 may be solid, or may be hollow (as shown) and provided with a number of holes 32 at its lower extremity above flange 44 for allowing admission of an inert gas to the rotatable device 18.

Cylindrical side wall 24 has an array of openings 34 therein. The openings in the array are circumferentially arranged in radial direction in a number of rows and spaced equidistantly from each other on the outside diameter of cylindrical side wall 24. Alternatively, the openings may be arranged in other patterns such as on a helix, not shown. As shown in FIG. 2, four rows 50 of round (cylindrical) openings 34 are arranged in radial direction in the cylindrical side wall 24. The size of the openings may be larger or smaller than the sizes of the particulates of the nickel added to the melt, but the size of the openings is generally smaller than the size of the agglomerates as formed in the melt. Generally, the size of the openings is such that nickel added into the device is essentially retained therein until substantially dissolved. Accretions of material tend to occur in the openings but the accretions will eventually be eroded and will disappear. It is, therefore, important that the openings are not so small that plugging occurs or that the flow of melt is too much impeded. On the other hand, the openings should not be so large that agglomerates are not retained before they have been sufficiently dissolved. We have found that diameters of the openings should be larger than about 3 mm. The openings preferably have a diameter in the range of about 3 to 16 mm.

Figure 4:
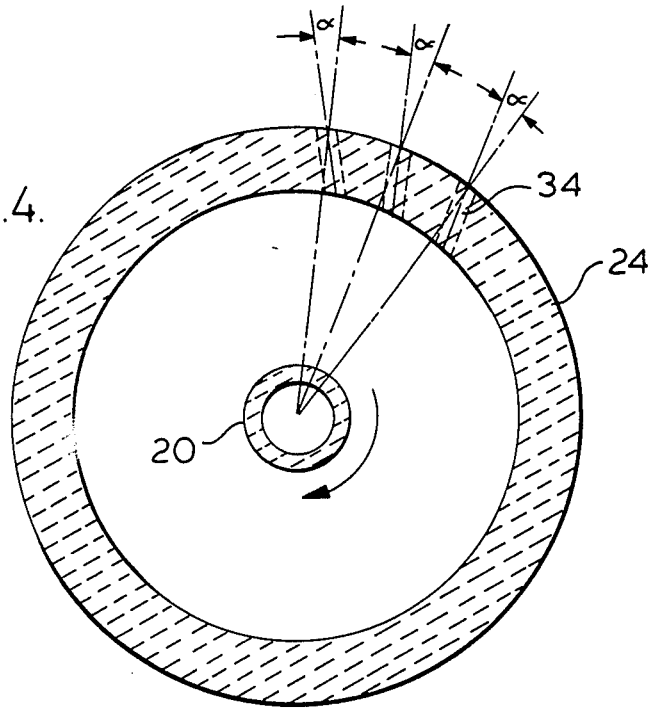
FIG. 4 is a schematical cross-section of the rotatable device through line 4—4 of FIG. 3 showing circular openings off-set at an angle to the radius.

In one modification of the round openings of the device, as shown in FIG. 4, the openings 34 are arranged in an oblique direction, i.e. off-set from the radius of the rotatable device in a direction against the direction of rotation. The angle alpha of the off-set may be in the range of about 1° to about 40°, preferably about 15°. The openings 34 of a circumferential row 50 of openings may, for example, be arranged equidistantly from each other on a 25 mm cord. The off-set of the openings facilitates the ease of flow of the melt through the rotatable device.

If desired, the openings 34 may diverge outwardly through the cylindrical wall 24 at a suitable angle of divergence in the range of about 1° to about 15°. The openings, with an angle of divergence, may decrease blockage if the device is run continuously at or near its maximum capacity.

Figure 5:
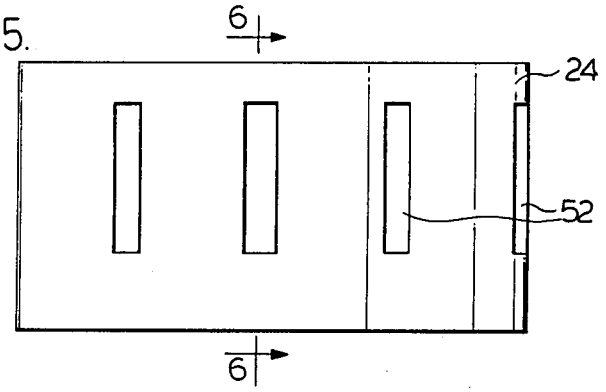
FIG. 5 is a side view of another embodiment of the rotatable device showing an array of rectangular side wall openings.
Figure 6:
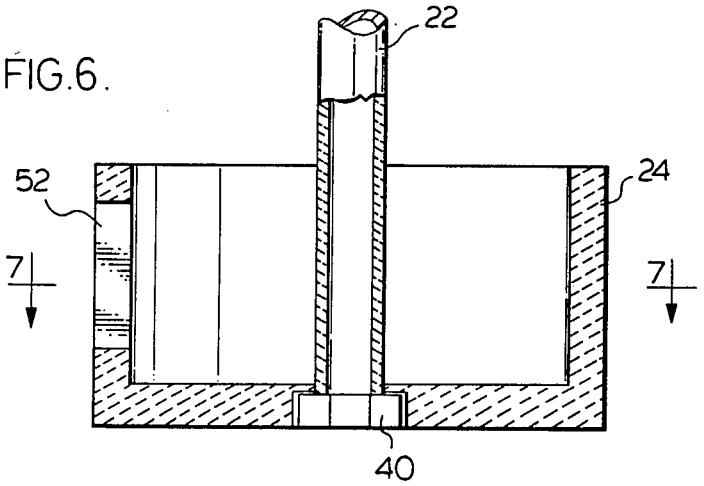
FIG. 6 is a cross-section of the rotatable device hollow cylinder of FIG. 5 through line 6—6 showing diverging rectangular openings.

With reference to a second embodiment of device 18 as shown in FIGS. 5 and 6, the rotatable device 18 is provided with an array of openings 52, each opening 52 being arranged circumferentially in a radial direction in cylindrical wall 24 and spaced, preferably, equidistantly from each other. Openings 52 have a usually verticallypositioned, rectangular cross section. If desired, openings 52 may be positioned at an angle from the vertical such as on a helix, not shown.

Figure 7:
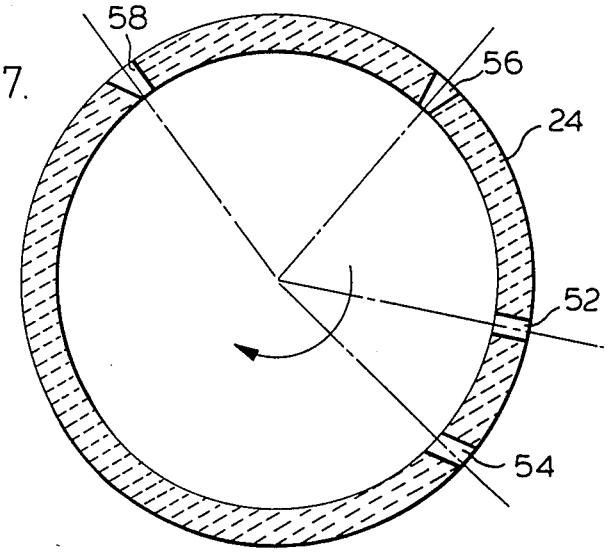
FIG. 7 is a cross-section of the rotatable device through line 7—7 of FIG. 6 schematically showing variations in rectangular openings.

The rectangular openings 52 may have different configurations and/or may be arranged radially or obliquely. For example, several variations are schematically indicated in FIG. 7. Thus, rectangular opening 52 indicates a radial, straight opening, opening 54 indicates a rectangular, straight opening arranged obliquely to the radial; opening 56 indicates a radially-directed, rectangular opening in plane which is outwardly diverging, and opening 58 indicates a rectangular, outwardly diverging 15 opening arranged obliquely to the radial.

The same considerations regarding the size of the openings as given above with respect to circular openings apply to rectangular openings. Each of the rectangular openings 52 and its variations 54, 56 and 58 has a width that is preferably greater than about 3 mm and has a surface area in the range of about 75 to 600 $mm^2$. Each opening has dimensions preferably in the range of about 3 to 12 mm wide and about 25 to 50 mm high. The number of rectangular openings may, for example, be in the range of about eight to sixteen. If arranged obliquely, the angle of off-set from the radius is in the range of about 1° to about 40°. In case the rectangular openings are outwardly divergent, the angle of divergence is in the range of about 1° to about 15°.

The invention will now be illustrated by the following non-limitative examples.

EXAMPLE 1

A rotatable device was made of graphite. The device had a diameter of 230 mm, a depth of 102 mm, a 25 mm thick solid bottom and four rows of 29 openings, each with a diameter of 8 mm. The openings were arranged equidistantly and at an angle of 15° from the radius. The surface area of the openings was 6.35% of that of the outside surface area of the cylindrical side wall. The device was submerged to a depth of 110 mm in a 465 kg charge of molten zinc contained at 525° C. in a heated vessel. The device was rotated at 375 rpm which caused a vortex to be drawn onto the bottom of the device. 8.37 kg of nickel powder, sufficient to yield a zinc alloy with 1.8% nickel, was added over a period of 2 minutes. After an additional 2 minutes of agitating the melt, the melt was sampled and the sample inspected for nickel. No nickel powder was discernable, as evidenced by SEM examination. This result demonstrates that nickel can be rapidly dissolved in molten zinc when added into a rotatable device according to the invention.

EXAMPLE 2

Two continuous production tests were carried out to determine the comparative performance of a conventional blade-type mixing device and a rotatable device according to the invention. The tests were carried out in a three-compartment furnace, as described, which included a generally circular mixing compartment with a diameter of 457 mm containing a charge of 5000 kg of prime western-grade zinc. To the charge were added nickel powder and lead for the production of zinc slabs containing nickel and lead having a specification of 0.45–0.55% nickel, 0.60–1.25% lead, balance zinc.

The rotatable device was made of graphite, had a diameter of 178 mm, a height of 127 mm, a depth of 102 mm and contained 84 openings in four rows of 21 equispaced openings, each with a diameter of 8 mm. The total surface area of the openings was 6% of the outside surface area of the cylindrical wall. The openings were obliquely arranged at a 15° angle from the radius against the direction of rotation. The ratio between the diameter of the mixing compartment and that of the device was 2.57. In both tests, nickel powder was added at a rate of 1.650 kg/min and lead was added in the form of a 9.5 mm wire at a rate of 2.803 kg/min. When using the rotatable device, the lead was fed as wire directly into the charge outside the device, and the nickel powder was added to the device into a vortex inside the device. The level of the charge in the mixing compartment of the furnace was controlled at a value varying not more than 25 mm. The top of the rotatable device, when stationary, was 100 mm below the level of the melt. During the dissolution of the nickel and the lead, the furnace temperature varied from 500° to 550° C. The rotatable device was rotated at 540 rpm and the blade-type device at 340 rpm during the tests.

The production was carried out by adding a continuous stream of molten zinc at a rate of 28,300 kg/h to the furnace and adding the required weights of nickel and lead to produce a melt from which zinc slabs were cast.

The melt was sampled thirty nine times just prior to casting and each sample analysed for its nickel and lead contents. From the analyses results, the standard deviations were calculated. When using the rotatable device, the calculated standard deviation was 0.0308% and when using the blade-type mixer, the deviation was 0.0547%.

The results show that, compared to a conventional type mixing device, the rotatable device according to the invention yields zinc slabs that are more homogeneous with a lower standard deviation.

We claim:

1. A method for the dissolution of nickel in molten zinc which comprises the steps of establishing a melt of zinc in a vessel; submerging a rotatable device in said melt; said rotatable device consisting of a hollow cylinder having a side wall with an upper end and a lower end, said cylinder being open at the upper end and closed at the lower end, said side wall having an array of equispaced openings adapted to retain nickel added in particulate form in said device in said rotatable device and to allow said molten zinc to pass through said openings, and means attached to the bottom plate for rotation of the rotatable device; rotating said rotatable device at a predetermined speed sufficient to draw at least a partial vortex in said melt of zinc and said rotatable device; feeding nickel in particulate form into said vortex in an amount sufficient to provide a melt of desired composition of zinc containing dissolved nickel; washing said nickel added in said device with said melt of zinc while rotating said device causing said molten zinc to flow into the top of said device and out through said openings; said washing with molten zinc while rotating said device causing dissolution of said nickel in said rotatable device and formation of a melt of zinc containing said predetermined amount of nickel; and withdrawing a melt of said desired composition from said vessel.

2. A method as claimed in claim 1, wherein said rotatable device has a diameter relative to the diameter of said vessel in the range of about 1.5:1 to about 3.5:1.

3. A method as claimed in claim 1, wherein said rotatable device is rotated at a predetermined speed in the range of about 100 to about 600 revolutions per minuted.

4. A method as claimed in claim 1, wherein, in addition to said predetermined amount of nickel, a predetermined amount of lead is dissolved in said melt, said predetermined amount of nickel and said predetermined amount of lead being sufficient to form a melt of predetermined composition containing nickel and lead dissolved in zinc.

5. A method as claimed in claim 1, wherein an inert gas is supplied in said vessel.

6. A method as claimed in claim 1, wherein said dissolution is carried out continuously by adding a measured amount of melt of zinc continuously to said vessel, adding nickel in particulate form continuously to the rotating, rotatable device at a predetermined rate sufficient to produce a zinc melt of the desired composition of nickel dissolved in zinc, continuously removing a volume of said zinc melt containing dissolved nickel from said vessel, and maintaining the level of melt in said vessel substantially constant, said zinc melt containing dissolved nickel removed from said vessel having a small standard deviation from composition specification.

7. A method as claimed in claim 1, wherein said zinc and said nickel form agglomerates and said agglomerates are retained in said device until substantially dissolved.

8. A method as claimed in claim 6, wherein in addition to said nickel, lead is continuously added to said vessel, and a melt of desired composition of nickel and lead dissolved in zinc is produced and is removed from said vessel.

9. A method as claimed in claim 6, wherein said zinc and said nickel form agglomerates and said agglomerates are retained in said device until substantially dissolved.

10. A method for dissolution of nickel in molten zinc which comprises the steps of establishing a melt of zinc in a vessel; submerging a rotatable device in said melt; said rotatable device comprising a hollow cylinder having a side wall with an upper end and a lower end, said cylinder being open at the upper end and closed at the lower end, said side wall having an array of equispaced openings adapted to allow said melt to pass through said openings, and said cylinder having a diameter relative to the diameter of the vessel in the range of about 1.5:1 to about 3.5:1; rotating said cylinder at a predetermined speed in the range of about 100 to about 600 revolutions per minute sufficient to draw at least a partial vortex in said melt into said rotatable device, causing said melt to flow into the top of said device and out through said side wall openings; adding a predetermined amount of nickel in particulate form in said rotatable device for the dissolution of said nickel in said molten zinc, said predetermined amount being sufficient to provide a melt of nickel and zinc of a desired composition; and withdrawing said melt of desired composition from said vessel.

11. A method as claimed in claim 10, wherein, in addition to said predetermined amount of nickel, a predetermined amount of lead is dissolved in said melt, said predetermined amount of nickel and said predetermined amount of lead being sufficient to form a melt of predetermined composition containing nickel and lead dissolved in zinc.

12. A method as claimed in claim 10, wherein said dissolution is carried out continuously by adding a measured amount of melt of zinc continuously to said vessel; adding nickel in particulate form continuously to the rotating, rotatable device at a predetermined rate sufficient to produce a melt of the desired composition of nickel dissolved in zinc; continously removing a volume of said zinc melt containing dissolved nickel from said vessel; and maintaining the level of melt in said vessel substantially constant, said zinc melt containing dissolved nickel removed from said vessel having a small standard deviation from composition specification.

13. A method as claimed in claim 12, wherein in addition to said nickel, lead is continuously added to said vessel, and a melt of desired composition of nickel and lead dissolved in zinc is produced and is removed from said vessel.

* * * * *